US005204041A

United States Patent [19]

Tashiro et al.

[11] Patent Number: 5,204,041

[45] Date of Patent: Apr. 20, 1993

[54] METHOD OF MAKING ULTRA-FINE POLYESTER FIBERS

[75] Inventors: Mikio Tashiro; Tsukasa Kobayashi, both of Matsuyama; Ryuji Uemura, Moriguchi, all of Japan

[73] Assignee: Teijin Limited, Osaka, Japan

[21] Appl. No.: 499,451

[22] PCT Filed: Oct. 27, 1989

[86] PCT No.: PCT/JP89/01111

§ 371 Date: Jun. 22, 1990

§ 102(e) Date: Jun. 22, 1990

[87] PCT Pub. No.: WO90/04666

PCT Pub. Date: May 3, 1990

[30] Foreign Application Priority Data

Oct. 28, 1988 [JP] Japan ..... 63-271024
Jan. 20, 1989 [JP] Japan ..... 1-9822

[51] Int. Cl.[5] ..... D01D 5/12; D02J 1/22

[52] U.S. Cl. ..... 264/210.8; 264/177.13; 264/342 RE

[58] Field of Search ..... 264/210.8, 177.13, 234, 264/342 RE; 528/295, 308.6; 428/288, 296, 297, 332, 397, 401

[56] References Cited

U.S. PATENT DOCUMENTS 3,748,844 7/1973 Pacofsky ..... 264/210.8
3,914,501 10/1975 Miller et al. ..... 156/155

FOREIGN PATENT DOCUMENTS 53-65417 6/1978 Japan .
56-33487 9/1981 Japan .
61-282500 12/1986 Japan .
62-250300 10/1987 Japan .

*Primary Examiner*—Leo B. Tentoni
*Attorney, Agent, or Firm*—Burgess, Ryan and Wayne

[57] ABSTRACT

A-type fibers having a fiber thickness of less than 1 denier is produced by the steps of: obtaining undrawn fibers by melt-spinning a co-polyester having an intrinsic viscosity of from 0.35 to 0.50, and having repeating units composed mainly of ethylneneterephthalate that contains from 0.5 mol % to 7.0 mol % of 5-sodiumsulfoisophthalic acid and from 0.5 mol % to 10 mol % of isophthalic acid; and flow-drawing the undrawn yarn at a draw ratio of more than 5 times. The A-type polyester fibers are further neck-drawn at a draw ratio of more than 1.05 times to be B-type fibers, and the B-type fibers are subjected to a restricted contraction treatment to be C-type fibers. Staple fibers having a length of less than 15 mm obtained from at least one of the A, B and C-type fibers are blended in a material for the production of a wet type non-woven fabric at a ratio of more than 10 weight %, if necessary, together with other fibers such as a regular type polyester fiber, wood pulp or a glass fiber. The resultant non-woven fabric has a soft hand and a uniform appearance as well as improved mechanical properties.

4 Claims, 1 Drawing Sheet

METHOD OF MAKING ULTRA-FINE POLYESTER FIBERS

BACKGROUND OF THE INVENTION

1. Technical Field

The present invention relates to a non-woven fabric with a favorable soft hand and a superior mechanical strength and elongation, and to polyester fibers for the production of the former.

2. Background Art

The technique for the production of a wet type non-woven fabric by utilizing chopped fine polyester fibers is known in the art, as disclosed in Japanese Unexamined Patent Publication (Kokai) Nos. 57-11209, 57-16916 or 57-139554. When such fine polyester fibers are produced by a conventional process, problems arise of a lower productivity due to a low discharge rate of a fiber per spinneret and of a high rate fiber breakage during the spinning operation due to a finer thickness of the fibers, which increase production costs. Moreover, the resultant non-woven fabric cannot provide a satisfactory quality due to many defects generated therein during a paper making process, although having a desirable soft hand.

Methods of obtaining fine polyester fibers through a flow drawing process have been disclosed in Japanese Examined Patent Publication (Kokoku) Nos. 28-617, 36-20772, 43-16670, 55-6734, and 55-14171, but no proposals have been made for the utilization of fibers obtained from these processes, as a material for a wet type non-woven fabric; because the fine polyester fibers obtained from a flow drawing process are sticky and have a poor openability, and thus many defects tend to occur during the paper making process.

Further, it is known to produce a wet type non-woven fabric with undrawn polyester fibers, but the undrawn polyester fibers obtained from a conventional spinning system have a thickness of at least 1 denier, and if thinner fibers are desired, a special quenching device must be used in the spinning system, as proposed in Japanese Examined Patent Publication (Kokoku) No. 63-17921. Nevertheless, the spinning conditions remain unsatisfactory even though such a device is utilized.

SUMMARY OF THE INVENTION

An object of the present invention is to solve the above drawbacks of the prior arts and to provide a novel method of producing ultra-fine polyester fibers through a flow drawing process, which fibers can be used for preparing a wet type non-woven fabric.

The above object is achieved by a method according to the present invention of producing ultra-fine polyester fibers, comprising the steps of: obtaining undrawn fibers by melt-spinning a co-polyester having an intrinsic viscosity of from 0.35 to 0.50, and containing repeating units which are composed mainly of ethyleneterephthalate containing from 0.5 mol % to 7.0 mol % of 5-sodiumsulfoisophthalic acid and 0.5 mol % to 10 mol % of isophthalic acid; and flow-drawing the undrawn fibers at a draw ratio of more than 5 times.

In one variant of this method, the ultra-fine polyester fibers obtained through the flow drawing of more than 5 times may be further subjected to a neck drawing process, to produce more shrinkable fibers.

The fibers obtained by the neck drawing process may be subjected to a shrinking process using a wet heat conditioned to contract the fibers by from 2% to 40%, to obtain modified fibers with a lower shrinkage rate.

The flow drawing process is preferably carried out while a polyether block polymer of from 0.02% to 5.0% by weight is imparted to the fibers.

The thus-obtained polyester fibers have a monofilament thickness of less than 1 denier, preferably less than 0.5 denier, more preferably less than 0.3 denier, and further preferably, have a non-circular cross section with projections on the periphery thereof.

Another object of the present invention is to provide a wet type non-woven fabric with superior qualities derived from the characteristics of the thus-obtained ultra-fine polyester fibers.

According to a further aspect of the present invention, a wet type non-woven fabric is provided through a paper making process by using a material comprising at least one of three type ultra-fine polyester fibers A, B and C; the fiber A being prepared only through the flow drawing process, the fiber B being prepared further through the neck drawing process after passing through the flow drawing process, and the fiber C being prepared further through the restricted contraction process after passing through the flow drawing process and the neck drawing process; the respective fiber being chopped to form staple fibers shorter than 15 mm in length, and if necessary, mixed with other fibers at a ratio of more than 10% by weight.

An optional two of the fibers A, B, and C are preferably selected and mixed with each other at a ratio of from 20/80 to 80/20.

The further fiber mixed with the inventive fibers when needed is preferably selected from a group of a regular type polyester fiber, a wood pulp, and a glass fiber.

Preferably, the obtained non-woven fabric is subjected to a calendering process, after the paper making, at a temperature higher than 165° C.

As stated above, since the ultra-fine polyester fibers according to the present invention is produced from a special co-polyester, the higher draw ratio can be adopted during the flow drawing process subsequent to the spinning process. Therefore, the resultant fibers do not stick to each other and have an improved openability and a preferable dispersibility in water. Such properties are suitable for the production of a wet type non-woven fabric.

Accordingly, the non-woven fabric made from these fibers has a uniform appearance and a superior mechanical strength and elongation, and a soft hand and a good opacity.

BRIEF DESCRIPTION OF THE DRAWINGS

The present invention will be described in more detail with reference to the preferred embodiments illustrated in the drawings, wherein FIGS. 1 through 6, respectively, show an enlarged view of an example of a cross section of an ultra-fine polyester fiber according to the present invention.

BEST MODE OF CARRYING OUT THE INVENTION

Figure 1:
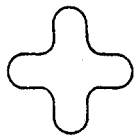
Figure 2:
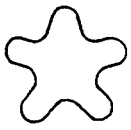
Figure 3:
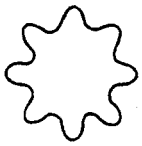
Figure 4:
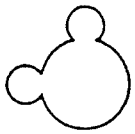
Figure 5:
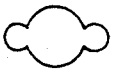
Figure 6:
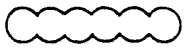

According to the present invention, a co-polyester having a special composition is utilized. Namely, if an undrawn yarn is subjected to a flow drawing process, which yarn is obtained from a conventional copolyester, such as polyethyleneterephthalate, including only a 5-sodiumsulfoisophthalic acid component, the resultant product has less stickiness. Nevertheless, a stable production cannot be obtained when the draw ratio is high, such as more than 5 times, because the fibers tend to be broken and wound around running rollers during the spinning, due to even a slight variation of the drawing temperature or the drawing speed. Although, in the case of a polyethyleneterephthalate including an isophthalic acid component, the flow drawability is better and the mechanical strength of the resultant fiber is high, the fibers are liable to stick to each other during the flow drawing process, and thus if the fiber is used for the production of the non-woven fabric, a dispersibility in water of the fiber is so poor that the quality of the obtained non-woven fabric is deteriorated.

The present inventors found that the utilization of a polyethyleneterephthalate containing a 5-sodiumsulfoisophthalic acid component and an isophthalic acid component at a particular composition ratio provides an extraordinary improvement both of the flow drawability and the prevention of stickiness between the respective fibers. The 5-sodiumsulfoisophthalic acid component and the isophthalic acid component may be either simultaneously copolymerized with the polyethyleneterephthalate or individually copolymerized therewith before being blended with each other.

Here, the 5-sodiumsulfoisophthalic acid component should be contained at a ratio of from 0.5 mol % to 7 mol %, preferably from 2.5 mol % to 6 mol %. If the content is not more than 0.5 mol %, the flow drawability is greatly deteriorated. This is also true when the content exceeds the upper limit of 7 mol %. In the range of between 0.5 mol % and 7 mol %, the improvement of the flow drawability as well as the prevention of fiber adhesion can be attained while using the isophthalic acid component in a range of from 0.5 mol % to 10 mol %, whereby the mechanical strength of a wet type non-woven fabric as a final product can be improved. As for the content of the isophthalic acid component, a range of from 2 mol % to 6 mol % is preferable. If the content is not more than 0.5 mol %, the flow drawability is extremely lowered, and conversely, if more than 10 mol %, the flowability is also deteriorated, and further, fiber adhesion occurs even though 5-sodiumsulfoisophthalic acid is contained therein.

The polyester used for the present invention should contain the above modified component and an intrinsic viscosity thereof (in the case of a polymer blend, the value is measured on this blended material) should be within a range of from 0.35 to 0.50. If outside of this range, the flow drawability is worsened so that a drawing of more than five times is impossible.

According to the present invention, an undrawn yarn is obtained from the above co-polyester through the conventional melt-spinning process. A cross-sectional shape of the spun fiber may be either circular or non-circular, but the non-circular shape is preferable for a smoother flow drawing, because a contact friction between fibers is less with the non-circular cross-sectional shapes than with the circular cross-section. Especially, when fibers having cross-sectional shapes with sharp projections on the surfaces thereof, as shown in FIGS. 1 through 6, are used as a material for a wet type non-woven fabric, the resultant non-woven fabric is suitable for a wiping cloth, because the projections are effective for scraping stains from a surface.

The undrawn fibers may be a multi-filament in which a plurality of filaments are collected to form a yarn, a mono-filament formed by a single fiber, or a tow forming a thicker fiber bundle.

A first step for obtaining ultra-fine polyester fibers according to the present invention is to flow-draw undrawn fibers produced through a melt-spinning of the above co-polyester.

This flow-drawing process is carried out in a hot water bath, in which an oil may be contained, at a temperature from 70° C. to 100° C., preferably from 78° C. to 95° C. Within this temperature range, a flow-drawing can be conducted without molecular orientation.

As stated before, the undrawn fibers according to the present invention have a good flow-drawability and can be stably drawn at a draw ratio of more than 5 times. The resultant fibers are less adhesive with each other and have an excellent dispersibility in water.

It is desirable to add a polyester/polyether block co-polymer to the undrawn fibers during the flow-drawing process, because the flow-drawing effect and the fiber adhesion preventive effect are further enhanced thereby. Besides these effects, the dispersibility of fibers in water is also improved according to the block copolymer adhered to the fibers during a wet process for paper making, whereby the product quality is improved. The reason for these effects is assumed to be that the block co-polymer is dispersedly adhered to the fiber surface and functions as a roller intervening between adjacent fibers, and thus decreasing friction therebetween. Since this block co-polymer is dispersed in a micro-particle form in a hot water bath, it does not coagulate even when heated at a high temperature required for a flow-drawing of a polyester fiber. This also is deemed as a factor resulting in the above effects.

The block co-polymer is preferably imparted to the polyester undrawn fibers by an oiling means immediately after the same has been spun, or to the fibers during a flow-drawing process while dispersed in a hot water bath.

The block co-polymer includes polyester/polyether block co-polymer composed of terephthalic acid and/or isophthalic acid and/or metasodiumsulfonic acid or lower alkylester thereof, lower alkyleneglycol and polyalkyleneglycol and/or polyalkyleneglycolmonoether, such as terephthalic acid-alkyleneglycol-polyalkyleneglycol, terephthalic acid-isophthalic acid-alkyleneglycol-polyalkyleneglycol, terephthalic acid-alkyleneglycol-polyalkyleneglycolmonoether, terephthalic acid-isophthalic acid-alkyleneglycol-polyalkyleneglycolmonoether, terephthalic acid-metasodiumsulfoisophthalic acid-alkyleneglycol-polyalkyleneglycol, terephthalic acid-isophthalic acid-metasodiumsulfoisophthalic acid-alkylenglycol-polyalkyleneglycol.

To enhance the prevention of fiber adhesion during a flow-drawing process, a ratio between a terephthalate unit and a sum of an isophthalate unit and/or a metasodiumsulfoisophthalate unit is preferably from 100:0 to 50:50 (mol %). To enhance a dispersibility in water of polyester fibers, the above ratio is particularly preferably from 90:10 to 50:50.

Generally, in this block co-polymer, a ratio between a sum of a terephthalate unit and an isophthalate or metasodiumsulfoisophthalate unit, and a polyalkyleneglycol unit is from 2:1 to 15:1 (molar ratio). To further enhance the prevention of fiber adhesion during a flow-drawing process and a dispersibility of fibers in water, the ratio is preferably from 3:1 to 8:1 (molar ratio).

The alkyleneglycol used for the production of this block co-polymer is one having 2 through 10 carbon atoms, such as ethyleneglycol, propyleneglycol, tetramethyleneglycol, decamethyleneglycol. The polyalkyleneglycol is preferably a polyethyleneglycol a polyethyleneglycol-polypropyleneglycol co-polymer, a polyethyleneglycol-polytetramethyleneglycol co-polymer, a polypropyleneglycol; and a monomethylether, monoethylether, and monophenylether of a polyethylene glycol, each having an average molecular weight from 600 to 12,000, preferably from 1,000 to 5,000. Particularly, a monoether of polyethyleneglycol is preferably for the fiber dispersibility in water.

An average molecular weight of this block co-polymer is generally from 2,000 to 20,000, preferably from 3,000 to 13,000, but this may vary in accordance with a molecular weight of polyalkyleneglycol used therefor. If the average molecular weight is outside of the above range, a flow-drawability, a fiber dispersibility in water, and a prevention of a fiber adhesion of undrawn fibers to which the block co-polymer is applied are poor. Preferably, the polyalkyleneglycol used for adjusting the molecular weight is one in which one of the end groups thereof is blocked, such as a monomethyl ether, monoethyl ether, or monophenyl ether.

The block co-polymer is dispersed in water with the aid of a surfactant such as an alkali metal salt of polyoxyethylene alkylphenyl ether phosphate, an alkali metal salt of polyoxyethylene alkylphenyl ether sulfate and/or ammonium salt thereof, and an alkanol amine salt. The block co-polymer is used in a range of from 0.02% to 5.0% in weight relative to polyester fiber according to the present invention, preferably from 0.1% to 3.0%.

The thus-obtained flow-drawn polyester fiber according to the present invention (A type fiber) has a high shrinkage of from 40% to 70% in boiling water and has a thickness of less than 1 denier suitable for the production of a wet type non-woven fabric. The fiber can be stably spun as an ultra-fine fiber having a thickness of from 0.05 denier to 0.2 denier. As the fiber obtained through a flow-drawing has a molecular orientation of at most the same level as that of the undrawn fiber, this fiber can be used as a binder for a non-woven fabric, in place of the undrawn fiber. Particularly, when a high temperature hot press is incorporated in the post process for the non-woven fabric, the adhesive effect is enhanced.

As stated above, while the A type fiber itself can be used as a material for the production of a non-woven fabric according to the present invention, this fiber can be given a further improved mechanical strength and elongation by further neck-drawing the same after the flow-drawing (B-type fiber). The process conditions of the neck-drawing may be as same as those adopted in the production of the conventional polyester fiber; for example, after the flow-drawing, the fiber is neck-drawn in hot water kept at a temperature of from 55° C. to 95° C., at a draw ratio of more than 1.05 times, preferably from 1.5 times to 5 times. The obtained B type fiber exhibits a higher tensile strength and a lower elongation relative to the undrawn fiber, and the handling thereof becomes easier in the post process. Nevertheless, the heat shrinkage is not greatly improved and remains at a high level. Accordingly, this type of fiber is not suitable for a usage in which the heat shrinkage is not required and/or is not favorable.

It is known that the neck-drawn polyester fiber should be heat-treated in the relaxed state to enhance a stability for heat thereof, but the fibers are liable to be adhered to each other by the heat treatment, which deteriorates the dispersibility of the fiber during the production of the wet type non-woven fabric according to the present invention, and results in a lower quality product. The present inventors found that the adhesion of the fibers can be avoided, and the fiber shrinkage in boiling water can be suppressed below 40%, if the fiber is subjected to a restricted contraction treatment from 2% to 40% in a wet heat environment. Namely, after the undrawn fiber is subjected to the above flow-drawing and neck-drawing, the resultant fiber is subjected to a restricted contraction treatment in a hot water bath maintained at a temperature of from 50° C. to 95° C., whereby a C-type fiber having an improved heat shrinkage is obtained.

The thus-obtained A, B and C type polyester fibers according to the present invention have a lower level tensile strength and modulus relative to the polyester fiber obtained through the conventional method. This makes the hand thereof very soft, and thus the touch of a non-woven fabric produced thereby is soft.

In this connection, the respective fibers through the flow-drawing process have a tensile strength of about 10% lower than that of the conventional polyester fiber, i.e., less than 5 g per 1 denier, while a specific weight thereof is smaller than that of the conventional polyester fiber and is from 1.250 to 1.375.

The polyester fibers according to the present invention obtained through a flow-drawing process (including fibers further subjected to a neck-drawing process or a restricted contraction treatment) have a thickness of less than 1 denier and a soft hand, and thus a non-woven fabric obtained therefrom has a soft touch. Particularly, this feature is prominently exhibited when the fiber thickness is less than 0.5 denier.

If the bulkiness is required, crimps of less than 20/25 mm may be imparted to the polyester fiber according to the present invention subjected to a neck-drawing process through a texturizing treatment. When the number of the crimps exceeds the above value, the quality of the non-woven fabric obtained from the fiber is lowered due to the deterioration of the dispersibility in water.

The polyester fiber according to the present invention is cut to staple fibers of shorter than 15 mm in length. If the fiber length is longer than 15 mm, the dispersibility in water is deteriorated. The shorter the fiber length, the better the dispersibility in water during the paper making process, which imparts a favorable effect on the obtained non-woven fabric. Nevertheless, if the fiber length is too short, such as less than 3 mm, the fiber adhesion is liable to occur due to a frictional heat generated between a cutter and fibers during the cutting process. This phenomena is remarkable in the fiber subjected only to a flow-drawing process. When the undrawn fiber is subjected to a flow-drawing process after the application of the polyester/polyether block co-polymer, fiber adhesion of the obtained fiber according to the present invention is prevented during the fiber cutting process due to the intervention of this block co-polymer between fibers. Also the fiber has an improved dispersibility in water during the paper making process.

As stated before, this block co-polymer is preferably applied, in an aqueous dispersion, to the undrawn fiber prior to or during the flow-drawing, but for the above purpose, it may be applied to the fiber obtained by the described method before the fiber has been cut by the cutter to form staple fibers.

As staple fibers obtained from the A-type fiber produced by flow-drawing the undrawn fiber have an excellent dispersibility in water and good adhesivity, the non-woven fabric obtained therefrom while mixed with other fibers through a wet paper making process has less unevenness and an excellent adhesive strength, elongation, and opacity.

As staple fibers obtained from the B-type fiber produced by flow-drawing the undrawn fiber and then neck-drawing the same have improved mechanical properties such as a high tensile strength and low elongation, they are suitable for the production of a printer paper for an information instrument, an adhesive label, a wall paper, a filter, a wiper, a towel, a tissue paper or the like.

As staple fibers obtained from the C-type fiber produced by flow-drawing and neck-drawing the undrawn fiber and then subjecting the same to a restricted contraction treatment have an improved dimensional stability against heat at the same level as that of the conventional low shrinkage fiber, the non-woven fabric produced therefrom forms no shrinkage unevenness even though subjected to the heat treatment.

These staple fibers according to the present invention are used for the production of a wet type non-woven fabric while mixed with other fibers to an extent in which the common feature thereof, i.e., a soft hand, is effective in the quality of the resultant product; namely, at a ratio of more than 10 weight %, preferably more than 30 weight %.

As stated before, the thickness of these fibers is less than 1 denier, preferably less than 0.5 denier. Since the number of constituent fibers increased in a non-woven fabric obtained, the entanglement between fibers becomes dense, whereby the mechanical properties thereof, such as tensile strength and elongation is improved, and further, the concealability, which is indispensable as a filter, is also enhanced. Moreover, the absorbability is improved due to the capillary action caused by the interstices between fibers, and a soft touch is obtained due to the lowering of the fiber bending stiffness.

When the fiber surfaces are covered by the polyester/polyether block co-polymer, the dispersibility of the fiber in water is further enhanced during the wet type paper making system and the qualities of the non-woven fabric, especially the tensile strength, elongation and opacity, are greatly improved. As this block copolymer has a good affinity with the polyester fiber according to the present invention, it still remains on the fiber surfaces at a ratio of from 0.03 weight % to 0.15 weight %, even after the same has been subjected to the paper making process, which improves the fabric qualities, particularly the absorbability and soft touch.

When the polyester fiber according to the present invention has a non-circular cross-section with projections on the periphery thereof as illustrated in FIGS. 1 through 6, the obtained non-woven fabric is suitable for the preparation of a wiping cloth, because these projections provide a wiping action.

When a non-woven fabric is produced from the polyester fiber according to the present invention, preferably at least two types of the fibers are selected from the above type fibers and mixed with each other, and according to this mixed use, the characteristics of the respective fibers are developed in a well-balanced manner in the resultant non-woven fabrics.

The mixed ratio is preferably from 20/80 to 80/20 in weight, more preferably from 40/60 to 60/40 in weight, in either a combination of A/B, B/C, or C/A.

Other fibers to be mixed with the polyester fibers according to the present invention includes synthetic fibers, such as regular type highly oriented polyester fibers not produced through a flow-drawing process, polyvinyl alcohol fibers, polyacrylic fibers, polyolefin fibers, polyamide fibers, polyvinylchloride fibers; regenerated fibers such as rayon, inorganic fibers such as glass fibers; and natural fibers made from wood pulp. Of these, the wet type non-woven fabric in which wood pulp or glass fibers constitute the substantial part and the polyester fibers according to the present invention are mixed therewith has a superior mechanical strength relative to that of a non-woven fabric lacking the latter fibers. This is because the copolyester composing the fibers according to the present invention has a high durability to water as well as a good affinity to wood pulp or glass fibers.

The non-woven fabric according to the present invention may be subjected to a hot press treatment with the aid of calender rolls, if necessary, whereby the mechanical strength thereof is further enhanced. Particularly, the non-woven fabric becomes a film-like structure having numerous micro-pores therein, when treated above 165° C. This product can be used in the commercial printing field, such as a poster, an envelope or a card, and a field in which a laminated sheet of a wet type non-woven fabric and a polyethylene film has been conventionally used, such as a map, a book, a peeling paper, a wrapping paper, or an electric insulator.

As stated above, a wet type non-woven fabric obtained by using, as part of material thereof, the polyester fibers according to the present invention has a softer hand, a higher mechanical strength, and a better water absorption relative to the conventional product. Suitable uses thereof are, for example, a PPC paper, a continuous slit paper, a thermal transfer recording paper, an ink-jet color recording paper; a sticky label, a seal, a sticky tape, a wall paper, a decorative material, a food wrapping paper, various filter papers, such as, for an air cleaner, an oil filter, an air filter, a liquid filter, a domestic filter (a tea bag, a coffee filter, oil straining paper, and an electric cleaner filter); an anti-corrosive paper, an anti-insect paper, a paper diaper, a disposable wiper, a medical paper, and a cosmetic paper. Particularly, it is suitable for those of a thin type having a fine texture.

EXAMPLES

The advantages and the features of the present invention will be more apparent from the following examples of the present invention:

In these examples, the respective characteristics of fibers and non-woven fabrics were measured as follows:

1. Flow-drawability

A filament breakage and a fiber winding around rolls occurring during a flow-drawing process were estimated at three levels; excellent, good, and not good.

2. Dispersibility in water

The dispersing state of fibers mixed in water at a ratio of 0.5 weight % was estimated through observation by the naked eyes in four ranks; excellent, good, usual, and not good.

3. Hand

The hand was estimated through the organoleptic test in which a test piece of the non-woven fabric (paper) is compared to a standard selected from one test group of similar examples.

In this connection, the standards for the respective experiment groups are as follows: a product of experiment 6 for the group consisting of examples 1 through 19; a product of experiment 24 for the group consisting of experiments 20 through 24; a product of experiment 25 for the group consisting of experiments 25 through 29; and a product of experiment 31 for the group consisting of experiments 30 through 36.

4. Appearance

The evenness of the appearance of the non-woven fabric was estimated through the organoleptic test by the naked eye at two levels; good and usual.

5. Strength

The longitudinal and transverse breakage strengths were measure by a constant speed type tensile tester under the conditions defined in JIS-P-8113. An average value of the two values was used as a measure of the strength.

6. Elongation

The longitudinal and transverse breakage elongations were measured by a constant speed type tensile tester under the conditions defined in JIS-P-8113. An average value of the two values was used as a measure of the elongation.

7. A basic weight and a thickness of the non-woven fabric were measured in accordance with JIS-P-8118, by which a density thereof was determined by the following equation:

$$\text{Density} = \text{Basic weight}/(\text{Thickness} \times 1000)\ \text{g/cm}^3$$

In this regard, the higher the density, the greater the improvement of the concealability of the non-woven fabric.

8. Water absorbability

Two kinds of test pieces were prepared along the longitudinal and transverse directions of the non-woven fabric in accordance with Clemm's method defined in JIS-P-8141. One end of the respective test piece was dipped in water for 1 minute, and the height of water absorbed and elevated through the test piece was measured. An average value of the two was determined.

9. Wiping property

A sample of dirt was prepared by blowing tobacco smoke onto a glass plate for 48 hours while a test piece of the non-woven fabric was wound around the surface of a plastic cylinder 10 cm$\phi \times$5 cm with a weight of 200 g. The cylinder coated with the test piece was placed on the sample of dirt and slid on the glass plate in a reciprocative manner only once at a stroke of 20 cm while not allowing the cylinder to rotate, so that the dirt is wiped from the glass plate by the test piece. The wiping property was estimated by the comparison of the dirt on the glass plate before and after the above wiping test, by the naked eye.

10. Dielectric breakdown voltage

In accordance with JIS-C-2110, the dielectric breakdown voltage of the non-woven fabric was measured by using stainless steel electrodes at a temperature of 20° C. and a relative humidity of 65%.

EXAMPLE 1

Fibers were spun at a rate of 900 m/min at 270° C. from a polyethylene-terephthalic polyester having an intrinsic viscosity of 0.4 and copolymerized with 5-sodiumsulfoisophthalic acid and isophthalic acid at various ratios, through a spinneret with 900 holes while melted at a temperature of 290° C. During spinning, an aqueous dispersing solution of polyester/polyether block polymer (hereinafter referred to as an oil X) was imparted as a spinning oil to undrawn fibers, as a spinning oil.

The oil X was an aqueous dispersion having an effective component of 10% in which terephthalic acid/isophthalic acid/ethyleneglycol/polyethyleneglycol co-polymer (terephthalic unit:isopthalic unit=70:30, terephthalic unit+isophthalic unit:polyethyleneglycol unit=5:1, a molecular weight of polyethylene=2,000, an average molecular weight of block copolymer=10,000) and a surfactant POE (10 mol) nonylphyenylether sulfate potassium salt combined at a ratio of 80:20.

Under the same conditions, except for replacing the spinning oil by POE (10 mol) nonylphenylether sulfate potassium salt (hereinafter referred to as an oil Y), other undrawn fibers were obtained.

Tows were formed from the respective undrawn fibers, which then were flow-drawn in a hot water bath kept at 90° C., at various draw ratios so that the total thickness of the resultant tow becomes 600,000 denier. Thus, various tows, each having different monofilament thickness were obtained. In the hot water bath, the oil X or Y the same as that used when the respective undrawn fibers have been spun was added to a 0.3% concentration.

Then the drawn tow was passed through a dipping bath in which the same oil as that used during the flow-drawing is added, so that the effective component of 0.4 weight % in oil X or that of 0.2 weight % in oil Y is adhered to the tow. The thus-obtained tows were cut to various staple lengths so that polyester fibers A-1 through A-11 listed in Table 1 were formed. Of these, the A-type polyester fibers and the comparative fibers thereto are included.

As apparent from this table, the comparative fibers A-7 and A-9 through A-11 produced from the copolyester not included within the scope of the present invention have an inferior flow-drawability, which results in an unstable production accompanied by many fiber breakages. In the case of the comparative fiber A-8 produced from the polyester copolymerized with isophthalic acid only, the flow-drawability thereof was no problem but the fibers thus-obtained were adhesive with each other and had an inferior dispersibility in water.

Also the comparative fibers A-3 having a staple length of 20 mm had problems in the dispersibility in water and were unsuitable for the production of a wet type non-woven fabric.

Conversely, example fibers A-1, 2, 4, 5 and 6 within the scope of the present invention were superior in both the flow-drawability and the dispersibility in water.

Particularly, the oil X gave a better result relative to the oil Y.

TABLE 1

| Fiber | Polymer Composition SIP (mol %) | Polymer Composition IA (mol %) | [η] | Flow-draw Temp. (°C.) | Flow-draw Ratio | Neck-draw Temp. (°C.) | Neck-draw Ratio | Contraction treatment Temp. (°C.) | Contraction treatment Ratio | Oil Type | Oil Amount (wt %) | Staple fiber Denier | Staple fiber Length (mm) | Flow drawability | Dispersibility in water | Remark |
|---|---|---|---|---|---|---|---|---|---|---|---|---|---|---|---|---|
| A-1 | 3 | 3 | 0.4 | 90 | 15 | | | | | X | 0.4 | 0.2 | 3 | Excellent | Excellent | Invention |
| A-2 | 3 | 3 | 0.4 | 90 | 8 | | | | | X | 0.4 | 0.5 | 5 | Excellent | Excellent | Invention |
| A-3 | 3 | 3 | 0.4 | 90 | 8 | | | | | X | 0.4 | 0.5 | 20 | Excellent | Not good | Blank |
| A-4 | 3 | 3 | 0.4 | 90 | 7.5 | | | | | X | 0.4 | 0.8 | 5 | Excellent | Excellent | Invention |
| A-5 | 3 | 3 | 0.4 | 90 | 5 | | | | | X | 0.4 | 1.2 | 5 | Excellent | Excellent | Invention |
| A-6 | 3 | 3 | 0.4 | 90 | 8 | | | | | Y | 0.2 | 0.5 | 5 | Good | Good | Invention |
| A-7 | 4 | 0 | 0.4 | 90 | 15 | | | | | X | 0.4 | 0.2 | | Not good | | Blank |
| A-8 | 0 | 4 | 0.4 | 90 | 15 | | | | | X | 0.4 | 0.2 | 3 | Good | Not good | Blank |
| A-9 | 3 | 12 | 0.4 | 90 | 15 | | | | | X | 0.4 | 0.2 | | Not good | | Blank |
| A-10 | 8 | 3 | 0.4 | 90 | 15 | | | | | X | 0.4 | 0.2 | | Not good | | Blank |
| A-11 | 3 | 3 | 0.55 | 90 | 15 | | | | | X | 0.4 | 0.2 | | Not good | | Blank |

EXAMPLE 2

TABLE 2

| Fiber | Polymer Composition SIP (mol %) | Polymer Composition IA (mol %) | [η] | Flow-draw Temp. (°C.) | Flow-draw Ratio | Neck-draw Temp. (°C.) | Neck-draw Ratio | Contraction treatment Temp. (°C.) | Contraction treatment Ratio | Oil Type | Oil Amount (wt %) | Staple fiber Denier | Staple fiber Length (mm) | Flow drawability | Dispersibility in water | Remark |
|---|---|---|---|---|---|---|---|---|---|---|---|---|---|---|---|---|
| A-12 | 1.4 | 2.8 | 0.49 | 90 | 15 | | | | | X | 0.4 | 0.2 | 3 | Excellent | Excellent | Invention |
| A-13 | 3.6 | 0.8 | 0.38 | 90 | 15 | | | | | X | 0.4 | 0.2 | 3 | Excellent | Excellent | Invention |
| A-14 | 0.4 | 7.2 | 0.56 | 90 | 15 | | | | | X | 0.4 | 0.2 | 3 | Good | Not good | Blank |
| A-15 | 3.8 | 0.4 | 0.36 | 90 | 15 | | | | | X | 0.4 | 0.2 | — | Not good | | Blank |

Material was prepared from polyethyleneterephthalate having an intrinsic viscosity of 0.35 and copolymerized with 5-sodiumsulfoisophthalic acid of 4 mol % and polyethylene-terephthalate having an intrinsic viscosity of 0.60 and copolymerized with isophthalic acid of 8 mol %, both of which are mixed together so that 5-sodiumsulfoisophthalic acid component and isophthalic component were blended at various ratios as listed in Table 2. Undrawn fibers were spun from the material under the same conditions as those in Example 1, which fibers were flow-drawn and cut to staple fibers, and thus the respective fibers A-12 through A-15 were obtained as listed in Table 2.

As apparent from the Table, the example fibers A-12 and A-13 exhibited superior results both in the flow-drawability and dispersibility in water, in which fibers the ratio of 5-sodiumsulfoisophthalic acid component and isophthalic acid component in the blended composition is included in the scope of the present invention.

EXAMPLE 3

Undrawn fibers were obtained from the same material and under the same conditions as those of fibers A-1 through A-6 in Example 1. The undrawn fibers were flow-drawn at various draw ratios, then neck-drawn in a hot water bath kept at 65° C., and the drawn tows were cut to form the B-type fibers B-1 through B-4 according to the present invention as listed in Table 3. Particularly, the fiber B-4 had a cross-section as shown in FIG. 1, because a spinneret with a cross-shaped spinning hole was used.

TABLE 3

| Fiber | Polymer Composition SIP (mol %) | Polymer Composition IA (mol %) | [η] | Flow-draw Temp. (°C.) | Flow-draw Ratio | Neck-draw Temp. (°C.) | Neck-draw Ratio | Contraction treatment Temp. (°C.) | Contraction treatment Ratio | Oil Type | Oil Amount (wt %) | Staple fiber Denier | Staple fiber Length (mm) | Flow drawability | Dispersibility in water | Remark |
|---|---|---|---|---|---|---|---|---|---|---|---|---|---|---|---|---|
| B-1 | 3 | 3 | 0.4 | 90 | 15.0 | 65 | 2.0 | | | X | 0.4 | 0.1 | 3 | Excellent | Excellent | Invention |
| B-2 | 3 | 3 | 0.4 | 90 | 6.5 | 65 | 1.23 | | | X | 0.4 | 0.5 | 5 | Excellent | Excellent | Invention |
| B-3 | 3 | 3 | 0.4 | 90 | 6.5 | 65 | 1.23 | | | Y | 0.2 | 0.5 | 5 | Good | Good | Invention |
| B-4 | 3 | 3 | 0.4 | 90 | 8.0 | 65 | 1.25 | | | X | 0.4 | 0.3 | 3 | Excellent | Excellent | Invention |

EXAMPLE 4

Undrawn fibers were obtained in the same manner as in Example 3, and after the neck-drawing, subjected to a restricted contraction treatment in a hot water bath kept at 90° C., and were then cut to form the C-type fibers C-1 through C-3 according to the present invention as listed in Table 4.

TABLE 4

| Fiber | Polymer Composition SIP (mol %) | Polymer Composition IA (mol %) | [η] | Flow-draw Temp. (°C.) | Flow-draw Ratio | Neck-draw Temp. (°C.) | Neck-draw Ratio | Contraction treatment Temp. (°C.) | Contraction treatment Ratio | Oil Type | Oil Amount (wt %) | Staple fiber Denier | Staple fiber Length (mm) | Flow drawability | Dispersibility in water | Remark |
|---|---|---|---|---|---|---|---|---|---|---|---|---|---|---|---|---|
| C-1 | 3 | 3 | 0.4 | 90 | 15.0 | 65 | 1.25 | 90 | 0.8 | X | 0.4 | 0.2 | 3 | Excellent | Excellent | Invention |
| C-2 | 3 | 3 | 0.4 | 90 | 8.0 | 65 | 1.25 | 90 | 0.8 | X | 0.4 | 0.5 | 5 | Excellent | Excellent | Invention |
| C-3 | 3 | 3 | 0.4 | 90 | 8.0 | 65 | 1.25 | 90 | 0.8 | Y | 0.2 | 0.5 | 5 | Good | Good | Invention |

EXAMPLE 5

Polyethylene-terephthalate chips having an intrinsic viscosity of 0.64 were melted at 300° C. and spun through a spinneret with 3,000 spinning holes, and taken up at a rate of 1,000 m/min as an undrawn tow of 1,200,000 total denier. The tow was neck-drawn at a draw ratio of 2.6 times in a hot water bath kept at 65° C., and then shrunk in a free state in the atmosphere kept at 140° C. to form a drawn tow having a monofilament thickness of 0.5 denier. The two was cut to staple fibers having a length of 5 mm. The thus-obtained fiber is referred to as the regular type polyethylene-terephthalate fiber R-1 in Table 5. In this regard, the oil Y was used during the spinning and drawing processes.

Moreover, the undrawn tow was cut to staple fibers 5 mm in length prior to being subjected to the drawing process, to form another fiber R-2.

These fibers R-1 and R-2 were mixed with the respective fibers obtained in Tests 1 through 4 and used as a material for the production of a wet type non-woven fabric. As apparent from Table 5, the dispersibility in water of these fibers remained at a good level without problems in practical use, even though slightly inferior to those of the polyester fibers of A, B and C-types according to the present invention.

TABLE 5

| Fiber | Polymer Composition SIP (mol %) | Polymer Composition IA (mol %) | [η] | Flow-draw Temp. (°C.) | Flow-draw Ratio | Neck-draw Temp. (°C.) | Neck-draw Ratio | Contraction treatment Temp. (°C.) | Contraction treatment Ratio | Oil Type | Oil Amount (wt %) | Staple fiber Denier | Staple fiber Length (mm) | Flow drawability | Dispersibility in water | Remark |
|---|---|---|---|---|---|---|---|---|---|---|---|---|---|---|---|---|
| R-1 | 0 | 0 | 0.64 | | | 65 | 2.0 | 90 | 1.3 | Y | 0.2 | 0.5 | 5 | | Usual | Blank |
| R-2 | 0 | 0 | 0.64 | | | | | | | Y | 0.2 | 1.1 | 5 | | Usual | Blank |

EXAMPLE 6

Materials for the production of a wet type non-woven fabric were prepared by mixing the respective fibers obtained from Examples 1 through 5 at various ratios with wood pulp or glass fiber. The respective material was dispersed in water so that a fiber concentration becomes less than 0.4 weight %, and was fed to a cylindrical net type paper making machine and dried and heat-treated at 120° C. by a yankee drier to form a wet type non-woven fabric having a basic weight of 50 through 80 g/cm$^2$.

In this connection, in experiments 37 through 40, a calender finish was further applied to the non-woven fabric, after being subjected to the dry/heat treatment, at 200° C. under a pressure of 200 kg/cm and at a conveying rate of 1.9 m/min.

The mixture ratios of fibers in the respective experiments and properties of the non-woven fabrics thus-obtained are listed in Table 6.

According to experiments 1 through 9, the non-woven fabrics mixed with the flow-drawn polyester fibers according to the present invention having a monofilament thickness of less than 1 denier have a uniform appearance and a soft hand, and an improved mechanical strength and water absorption. Particularly, the non-woven fabric in accordance with experiment 1, in which the A-type fibers having a monofilament thickness of 0.2 denier are mixed, is superior both in the strength and water absorption. Conversely, the non-woven fabric according to experiment 4, in which the A-type fibers having a monofilament thickness of 1.2 denier are mixed, and those according to experiments 6 and 7, in which the polyester fibers not flow-drawn were mixed, exhibit a hard hand and low values both in the mechanical strength and the water absorption. In experiment 9, since the adhesive fiber R-2 acts as a binder between the C-type fiber according to the present invention and the regular type polyethylene-terephthalate fiber R-1, both non-adhesive, the non-woven fabric has an excellent strength and water absorption, due to the characteristics of the C-type fiber.

Experiments 10 through 14 are embodiments in which the non-woven fabric is formed only from either two of the A, B, and C-type fibers. In these cases, it is characteristic that the non-woven fabric according to the present invention, in which the A-type fiber is mixed, has higher strength and elongation values.

Experiments 15 through 19 are the embodiments in which the non-woven fabric is formed from either two of the A, B, and C-type fibers mixed with the regular type polyethylene-terephthalate fiber.

Experiments 20 through 24 are the embodiments in which the wood pulp is used as one of the materials. It will be apparent that the non-woven fabric mixed with the fiber according to the present invention has a soft hand as well as a higher strength.

Experiments 25 through 27 are the embodiments in which glass fiber having an average diameter of 0.5 mm (glass wool) is used as the other fiber.

According to experiments 28 and 29, only a glass fiber is used for the wet type paper making, without the use of the fibers of the present invention. The paper making, however, was impossible due to a lack of adhesiveness.

Experiments 30 through 36 are the embodiments in which the wiping properties of non-woven fabrics, each produced from one of the A, B and C type fibers obtained through a flow-drawing process and blended with the regular type polyethylene-terephthalate fiber, were compared with each other. According to these experiments, it will be apparent that the non-woven fabric including the fiber within the scope of the present invention of more than 10 weight % exhibits an excellent wiping property. Particularly, as shown in Experiment 4, the non-woven fabric including the fiber having a cross-section illustrated in FIG. 1 exhibits a superior property.

Experiments 37 through 40 are the embodiments in which the breakdown voltages of non-woven-fabrics, each produced from one of the A and B type fibers according to the present invention, blended with the regular type polyethylene-terepthalate fiber in various ratios, were compared from each other, after the same have been subjected to a calendering process. It will be apparent from the results that a higher breakdown voltage is obtained when the blend ratio is more than 10 weight %. This is because the non-woven fabric has a uniform composition and has less micro-pores on the surface thereof.

TABLE 6 (1)

| Experiment No. | Blended fibers: Flow-drawn fiber I | Flow-drawn fiber II | Other fiber III | Other fiber IV | Blend ratio I % | Blend ratio II % | Blend ratio III % | Blend ratio IV % | Basic weight g/cm² | Wet-type non-woven fabric: Hand | Appearance | Density g/cm³ | Strength kg/mm² | Elongation % | Absorbability | Remark |
|---|---|---|---|---|---|---|---|---|---|---|---|---|---|---|---|---|
| 1 | A-1 | | R-1 | | 40 | | 60 | | 50 | Soft | Good | 0.45 | 0.78 | 2.5 | 75 | Invention |
| 2 | A-2 | | R-1 | | 40 | | 60 | | 50 | Soft | Good | 0.41 | 0.65 | 2.3 | 28 | Invention |
| 3 | A-4 | | R-1 | | 15 | | 85 | | 50 | Soft | Usual | 0.32 | 0.28 | 1.6 | 9 | Invention |
| 4 | A-5 | | R-1 | | 40 | | 60 | | 50 | Same | Usual | 0.34 | 0.35 | 1.9 | 3 | Blank |
| 5 | A-6 | | R-1 | | 40 | | 60 | | 50 | Soft | Good | 0.39 | 0.57 | 2.2 | 25 | Invention |
| 6 | | | R-1 | R-2 | | | 60 | 40 | 50 | (Ref.) | Usual | 0.34 | 0.15 | 1.1 | 2 | Blank |
| 7 | | | R-1 | R-2 | | | 85 | 15 | 50 | Soft | Usual | 0.30 | 0.10 | 1.0 | 3 | Blank |
| 8 | B-2 | | R-1 | | 15 | | 85 | | 50 | Soft | Usual | 0.32 | 0.25 | 1.6 | 10 | Invention |
| 9 | C-2 | | R-1 | R-2 | 15 | | 70 | 15 | 50 | Soft | Usual | 0.32 | 0.18 | 1.4 | 10 | Invention |

TABLE 6 (2)

| Experiment No. | Blended fibers: Flow-drawn fiber I | Flow-drawn fiber II | Other fiber III | Other fiber IV | Blend ratio I % | Blend ratio II % | Blend ratio III % | Blend ratio IV % | Basic weight g/cm² | Wet-type non-woven fabric: Hand | Appearance | Density g/cm³ | Strength kg/mm² | Elongation % | Absorbability | Remark |
|---|---|---|---|---|---|---|---|---|---|---|---|---|---|---|---|---|
| 10 | A-2 | C-2 | | | 40 | 60 | | | 50 | Soft | Good | 0.52 | 1.2 | 13.8 | 85 | Invention |
| 11 | B-2 | C-2 | | | 40 | 60 | | | 50 | Very Soft | Good | 0.45 | 0.51 | 2.0 | 95 | Invention |
| 12 | A-2 | B-2 | | | 40 | 60 | | | 50 | Soft | Good | 0.54 | 1.3 | 16.5 | 88 | Invention |
| 13 | A-1 | B-1 | | | 40 | 60 | | | 50 | Soft | Good | 0.59 | 1.4 | 25 | 60 | Invention |
| 14 | A-6 | C-3 | | | 40 | 60 | | | 50 | Soft | Good | 0.50 | 1.1 | 12.5 | 81 | Invention |
| 15 | A-1 | C-1 | R-1 | | 20 | 30 | 50 | | 50 | Soft | Good | 0.46 | 0.7 | 12.2 | 82 | Invention |
| 16 | A-1 | B-1 | R-1 | | 20 | 30 | 50 | | 50 | Soft | Good | 0.45 | 0.7 | 18 | 90 | Invention |
| 17 | A-2 | B-2 | R-1 | | 8 | 8 | 84 | | 50 | Soft | Usual | 0.33 | 0.28 | 1.8 | 13 | Invention |
| 18 | A-2 | C-2 | R-1 | | 8 | 8 | 84 | | 50 | Soft | Usual | 0.31 | 0.18 | 1.3 | 18 | Invention |
| 19 | B-2 | C-2 | R-1 | | 8 | 8 | 84 | | 50 | Soft | Usual | 0.30 | 0.15 | 1.2 | 18 | Invention |

TABLE 6 (3)

| Experiment No. | Blended fibers: Flow-drawn fiber I | Flow-drawn fiber II | Other fiber III | Other fiber IV | Blend ratio I % | Blend ratio II % | Blend ratio III % | Blend ratio IV % | Basic weight g/cm² | Wet-type non-woven fabric: Hand | Appearance | Density g/cm³ | Strength kg/mm² | Elongation % | Absorbability | Remark |
|---|---|---|---|---|---|---|---|---|---|---|---|---|---|---|---|---|
| 20 | A-2 | | | Pulp | 40 | | | 60 | 80 | Soft | Usual | 0.55 | 2.3 | 5.7 | | Invention |
| 21 | B-2 | | | Pulp | 40 | | | 60 | 80 | Soft | Usual | 0.49 | 2.0 | 4.9 | | Invention |
| 22 | C-2 | | | Pulp | 40 | | | 60 | 80 | Soft | Usual | 0.44 | 1.5 | 3.4 | | Invention |
| 23 | | | R-1 | Pulp | | | 40 | 60 | 80 | Soft | Usual | 0.38 | 0.9 | 2.3 | | Blank |
| 24 | | | | Pulp | | | | 100 | 80 | Standard | Usual | 0.57 | 3.2 | 4.0 | | Blank |
| 25 | A-2 | | | Glass | 40 | | | 60 | 80 | Standard | Usual | 0.48 | 0.46 | 3.2 | | Invention |
| 26 | B-2 | | | Glass | 40 | | | 60 | 80 | Same | Usual | 0.43 | 0.32 | 2.3 | | Invention |
| 27 | C-2 | | | Glass | 40 | | | 60 | 80 | Same | Usual | 0.43 | 0.21 | 2.0 | | Invention |
| 28 | | | R-1 | Glass | | | 40 | 60 | 80 | | | — | — | — | | Blank* |
| 29 | | | | Glass | | | | 100 | 80 | | | — | — | — | | Blank* |

*Paper making was impossible due to lack of adhesiveness.

TABLE 6 (4)

| Experiment No. | Blended fibers: Flow-drawn fiber I | Flow-drawn fiber II | Other fiber III | Other fiber IV | Blend ratio I % | Blend ratio II % | Blend ratio III % | Blend ratio IV % | Basic weight g/cm² | Wet-type non-woven fabric: Hand | Appearance | Density g/cm³ | Strength kg/mm² | Elongation % | Absorbability | Remark |
|---|---|---|---|---|---|---|---|---|---|---|---|---|---|---|---|---|
| 30 | A-2 | | R-1 | | 20 | | 80 | | 50 | Slightly soft | Usual | 0.33 | 0.27 | 1.6 | Good | Invention |
| 31 | A-2 | | R-1 | | 5 | | 95 | | 50 | Standard | Usual | 0.31 | 0.10 | 1.0 | Not good | Blank |
| 32 | B-4 | | R-1 | | 50 | | 50 | | 50 | Soft | Good | 0.33 | 0.27 | 2.0 | Excellent | Invention |
| 33 | B-2 | | R-1 | | 20 | | 80 | | 50 | Soft | Usual | 0.33 | 0.25 | 1.5 | Good | Invention |
| 34 | B-2 | | R-1 | | 5 | | 95 | | 50 | Slightly soft | Usual | 0.31 | 0.10 | 1.0 | Not good | Blank |
| 35 | C-2 | | R-1 | | 20 | | 80 | | 50 | Soft | Usual | 0.33 | 0.22 | 1.3 | Good | Invention |
| 36 | C-2 | | R-1 | | 5 | | 95 | | 50 | Slightly soft | Usual | 0.31 | 0.09 | 1.0 | Not good | Blank |

TABLE 6 (5)

| Experiment No. | Blended fibers: Flow-drawn fiber I | Flow-drawn fiber II | Other fiber III | Other fiber IV | Blend ratio I % | Blend ratio II % | Blend ratio III % | Blend ratio IV % | Basic weight g/cm² | Wet-type non-woven fabric: Hand | Appearance | Density g/cm³ | Strength kg/mm² | Elongation % | Absorbability | Remark |
|---|---|---|---|---|---|---|---|---|---|---|---|---|---|---|---|---|
| 37 | A-2 | | R-1 | | 15 | | 85 | | 80 | — | Usual | 1.15 | 5.0 | 5.1 | 13 | Invention |
| 38 | A-2 | | R-1 | | 5 | | 95 | | 80 | — | Usual | 1.00 | 3.8 | 2.1 | 8 | Blank |
| 39 | B-2 | | R-1 | | 15 | | 85 | | 80 | — | Usual | 1.08 | 4.5 | 3.8 | 11 | Invention |
| 40 | B-2 | | R-1 | | 5 | | 95 | | 80 | — | Usual | 1.00 | 3.7 | 2.1 | 7 | Blank |

EFFECTS OF THE INVENTION

As state above, according to the present invention, a co-polyester having particular compositions is used as a material for producing undrawn fibers having a good flow-drawability, which are subjected to a flow-drawing process, cut to staple fibers, then mixed with other fibers in predetermined ratios to form a material for the production of a wet type non-woven fabric. The non-woven fabric thus-obtained has a softer hand, a more uniform appearance, and better mechanical properties relative to those of the conventional fabrics.

We claim:

1. A method of producing ultra-fine polyester fibers, consisting essentially of: obtaining undrawn fibers by melt-spinning a co-polyester having an intrinsic viscosity of from 0.35 to 0.50, and having repeating units composed mainly of ethylene-terephthalate that contains from 0.5 mol % to 7.0 mol % of 5-sodium-sulfoisophthalic acid and from 0.5 mol % to 10 mol % of isophthalic acid; and flow-drawing the undrawn fibers at a draw ratio of more than 5 times.

2. A method as defined in claim 1, wherein the polyester fibers are further neck-drawn at a draw ratio of more than 1.05 times after the flow-drawing.

3. A method as defined in claim 1, wherein the polyester fibers are further neck-drawn at a draw ratio of more than 1.05 times after the flow-drawing, and then are subjected to a restricted contraction treatment in which the fibers are shrunk by 2% through 40% in length in a wet heat environment.

4. A method as defined in any of claims 1 through 3, wherein the flow-drawing is carried out while a polyether block co-polymer is imparted to the undrawn fibers at a ratio of from 0.02 weight % to 5.0 weight %.

* * * * *